US009527324B2

(12) United States Patent
Aoyama et al.

(10) Patent No.: US 9,527,324 B2
(45) Date of Patent: Dec. 27, 2016

(54) CONTROL DEVICE, CONTROL METHOD, AND STORAGE MEDIUM

(71) Applicant: CANON KABUSHIKI KAISHA, Tokyo (JP)

(72) Inventors: Naoki Aoyama, Tokyo (JP); Koya Iwakura, Kawasaki (JP); Tetsuya Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/829,513

(22) Filed: Aug. 18, 2015

(65) Prior Publication Data

US 2016/0052315 A1 Feb. 25, 2016

(30) Foreign Application Priority Data

Aug. 22, 2014 (JP) ..... 2014-169778

(51) Int. Cl.

| | |
|---|---|
| ***B41J 11/00*** | (2006.01) |
| ***B41J 29/393*** | (2006.01) |
| ***B41J 29/38*** | (2006.01) |
| ***B41J 19/14*** | (2006.01) |
| ***B41J 19/20*** | (2006.01) |
| ***B41J 29/02*** | (2006.01) |

(52) U.S. Cl.

CPC ..... *B41J 29/38* (2013.01); *B41J 19/142* (2013.01); *B41J 19/207* (2013.01); *B41J 29/02* (2013.01)

(58) Field of Classification Search

CPC ..... B41J 29/393; B41J 11/006; B41J 11/0095; B41J 2/393

See application file for complete search history.

(56) References Cited

U.S. PATENT DOCUMENTS

2009/0015621 A1* 1/2009 Hirota ..... B41J 2/2142 347/19
2011/0122188 A1* 5/2011 Mitsunaga ..... B41J 11/006 347/16
2011/0227979 A1* 9/2011 Morishita ..... B41J 11/0095 347/14

(Continued)

FOREIGN PATENT DOCUMENTS

JP H02-103168 A 4/1990
JP 2002-127569 A 5/2002

(Continued)

*Primary Examiner* — Jason Uhlenhake

(74) *Attorney, Agent, or Firm* — Canon USA, Inc. I.P. Division

(57) ABSTRACT

A control unit includes a moving unit that causes a recording unit to move in a reciprocating manner, a detection unit that detects a movement error of the moving unit, a control unit that controls the moving unit such that the recording unit is caused to move in a second direction if the movement error is detected while the recording unit is caused to move in a first direction, a notification unit that issues error notification according to a result of movement of the moving unit, and an execution unit that executes an operation for identifying a cause of the movement error of the moving unit in a case where the moving unit has been able to move in the second direction by the controlling of the control unit, wherein the notification unit issues error notification according to an execution result of the operation by the execution unit.

16 Claims, 6 Drawing Sheets

(56) References Cited

U.S. PATENT DOCUMENTS

2012/0007904 A1* 1/2012 Anzai ..... B41J 11/006
347/9

FOREIGN PATENT DOCUMENTS

| | | | |
|---|---|---|---|
| JP | 2003-211800 | A | 7/2003 |
| JP | 2010-274442 | A | 12/2010 |
| JP | 2012-020407 | A | 2/2012 |
| JP | 2012-192675 | A | 10/2012 |

* cited by examiner

CONTROL DEVICE, CONTROL METHOD, AND STORAGE MEDIUM

BACKGROUND OF THE INVENTION

Field of the Invention

The present invention relates to a control device that detects a movement error, a control method, and a storage medium.

Description of the Related Art

In a serial-type inkjet recording apparatus, a carriage including a recording head makes reciprocating movements, and a recording material such as ink is ejected to perform recording on a recording medium. A conveyance roller conveys the recording medium along with formation of an image that is performed resulting from the reciprocating movements of the carriage, so that the image is formed on the recording medium. Such a recording apparatus is known to have a function of stopping the carriage if an abnormality is detected while the carriage is moving. However, such a function causes the recording apparatus to stop the carriage whenever any abnormality is detected in the carriage, that is, even if a situation is such that the recording apparatus can be returned to a normal state by a user. Hence, Japanese Patent Application Laid-Open No. 2002-127569 discusses a method in which an operation of a carriage is monitored, and status information is stored when an abnormality is detected. The status information thus stored is displayed, printed, or transmitted.

However, according to the method discussed in Japanese Patent Application Laid-Open No. 2002-127569, the status information stored at the time of abnormality detection is merely displayed. Thus, in this method, a cause of the abnormality in the carriage cannot be found out because the displayed information is not analyzed. Moreover, as mentioned in Japanese Patent Application Laid-Open No. 2002-127569, there are cases where a cause of the abnormality cannot be identified by simply checking operation history information. Information obtained prior to the abnormality detection is a history of a state in which the carriage has been operated normally. Thus, the history information is more likely to be similar for abnormalities originated from different causes. That is, obtaining only information at the time of abnormality detection and information prior to abnormality detection, such as history information or operation information, is not sufficient to identify a cause of an abnormality.

SUMMARY OF THE INVENTION

According to an aspect of the present invention, a control device includes a moving unit configured to cause a recording unit to move in a reciprocating manner, a detection unit configured to detect a movement error of the moving unit, a control unit configured to control the moving unit such that the recording unit is caused to move in a second direction in a case where the movement error is detected by the detection unit while the recording unit is being caused to move in a first direction, a notification unit configured to issue error notification according to a result of movement of the moving unit controlled by the control unit, and an execution unit configured to execute an operation for identifying a cause of the movement error of the moving unit in a case where the moving unit has been able to move in the second direction by the controlling of the control unit, wherein the notification unit issues error notification according to an execution result of the operation by the execution unit.

Further features of the present invention will become apparent from the following description of exemplary embodiments with reference to the attached drawings.

DESCRIPTION OF THE EMBODIMENTS

Exemplary embodiments of the present invention will be described below with reference to the drawings. Relative arrangements of components of an apparatus and shape of the apparatus described in the exemplary embodiments are merely examples, and not limited thereto. Hereinafter, one exemplary embodiment of the present invention is described in detail with reference to the drawings.

Figure 1:
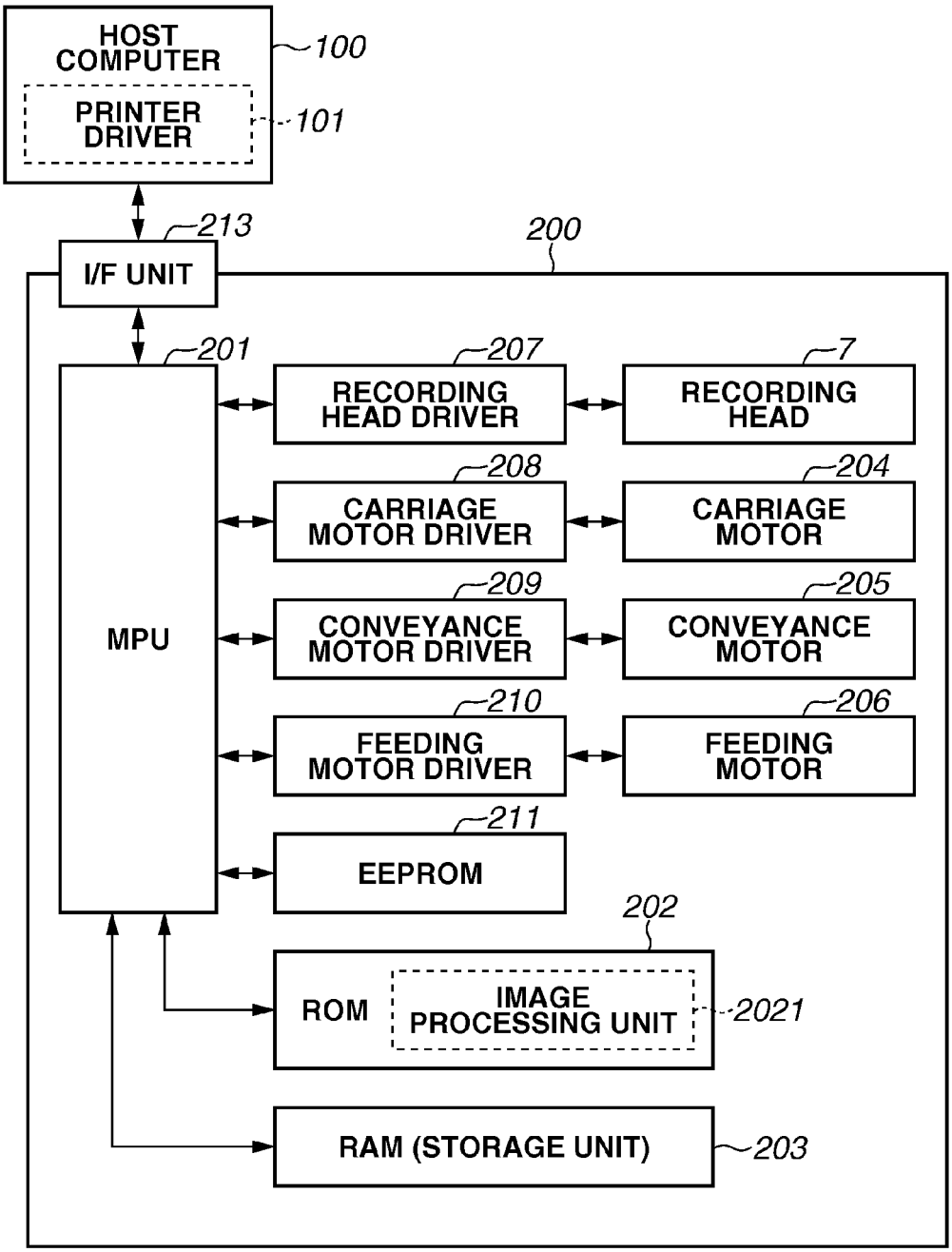
FIG. 1 is a block diagram illustrating a recording apparatus according to one exemplary embodiment of the present invention.

FIG. 1 is a block diagram illustrating a recording apparatus 200 according to one exemplary embodiment of a control device of a first exemplary embodiment. In FIG. 1, the recording apparatus 200 has only a printing function. However, the recording apparatus 200 is not limited thereto. The recording apparatus 200 may be a multifunctional peripheral (MFP) including other functions such as a scanner function, a facsimile function, or the like. When abnormality detection processing of the recording apparatus 200 is controlled based on an instruction from an external device connected to the recording apparatus 200, the external device serves as a control device. The abnormality detection processing will be described later.

As illustrated in FIG. 1, the recording apparatus 200 includes a micro processing unit (MPU) 201, a read only memory (ROM) 202, a random access memory (RAM) 203, and an electrically erasable and programmable read-only memory (EEPROM) 211. Moreover, the recording apparatus 200 includes a recording head driver 207, a carriage motor driver 208, a conveyance motor driver 209, and a feeding motor driver 210 that are connected to a recording head 7, a carriage motor 204, a conveyance motor 205, and a feeding motor 206, respectively.

Moreover, the recording apparatus 200 includes an interface (I/F) unit 213, and is connected to a host computer 100 via a network, for example.

The MPU 201 controls, for example, an operation of each unit and data processing. The MPU 201 controls driving of the conveyance motor 205 via the conveyance motor driver 209 so that a recording sheet is conveyed. The MPU 201 controls driving of the carriage motor 204 via the carriage motor driver 208, so that scanning for printing is performed. Moreover, the MPU 201 controls the feeding motor 206 via the feeding motor driver 210 to control driving of a pick-up roller 2 and a feeding roller 3 which will be described below. That is, the MPU 201 also functions as a motor control unit. Moreover, the MPU 201 exchanges data such as a recorded image with the host computer 100 via the I/F unit 213 serving as a communication interface.

The ROM 202 stores programs that are executed by the MPU 201 and data. The ROM 202 includes an image processing unit 2021, and is capable of executing image processing. The RAM 203 temporarily stores processing data to be executed by the MPU 201 and data received from the host computer 100. The EEPROM 211 stores a status and control information that needs to be retained even when power is not supplied, the status and the control information being related to processing that is executed by the MPU 201.

The recording head driver 207 controls the recording head 7. The carriage motor driver 208 controls the carriage motor 204 for driving a carriage. The conveyance motor 205 drives a conveyance roller 5 and a discharge roller 9. The conveyance motor 205 is controlled by the conveyance motor driver 209. The feeding motor 206 drives the pickup roller 2 and the feeding roller 3. The feeding motor 206 is controlled by the feeding motor driver 210.

The host computer 100 is a personal computer (PC), for example. The host computer 100 includes a printer driver 101. When a user issues a recording operation execution command, the printer driver 101 coordinates recorded information such as a recorded image and a recorded image quality, and performs communication of the recorded information with the recording apparatus 200. The printer driver 101 is provided by, for example, installation.

The recording apparatus 200 includes an operation unit (not illustrated) via which various instructions is issued to the MPU 201, and a display unit (not illustrated) for displaying various information and messages by being controlled by the MPU 201. The display unit displays a warning message and an error message, for example. The operation unit may include the display unit. The operation unit may be, for example, a touch panel. In such a case, the operation unit includes, for example, various keys such as a start/stop key, a numeric keypad, a function key, a YES/NO key, and a cursor key, a display device such as a liquid crystal display (LCD) and a light emitting diode (LED), and a voice output device.

Figure 2:
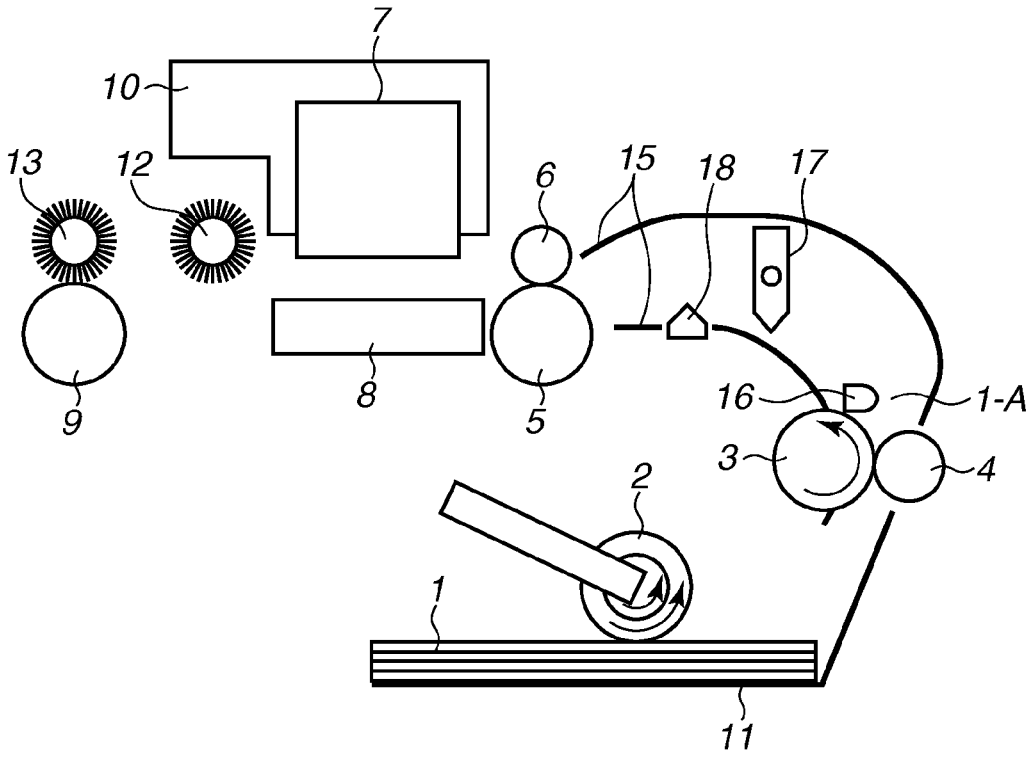
FIG. 2 is a sectional view in a conveyance direction of the recording apparatus according to one exemplary embodiment of the present invention.

FIG. 2 is a sectional view illustrating, in a direction intersecting with a sheet conveyance direction, the recording apparatus 200 according to the present exemplary embodiment.

A plurality of recording sheets 1 is stacked in a feeding tray (a stacking unit) 11. The pickup roller 2 contacts a recording sheet 1 on the top of the plurality of recording sheets stacked in the feeding tray 11 to pick up this recording sheet 1.

The feeding roller 3 feeds the recording sheet 1 picked up by the pickup roller 2 toward a downstream side in a sheet conveyance direction. A feeding driven roller 4 is urged toward the feeding roller 3, so that the feeding driven roller 4 and the feeding roller 3 pinch and feed the recording sheet 1.

The conveyance roller 5 conveys the recording sheet 1 fed by the feeding roller 3 and the feeding driven roller 4 to a position opposite the recording head 7. A pinch roller 6 is urged toward the conveyance roller 5, so that the pinch roller 6 and the conveyance roller 5 pinch and convey the recording sheet 1.

The recording head 7 ejects a recording material onto the recording sheet 1 conveyed by the conveyance roller 5 and the pinch roller 6 while a carriage 10 is moving, thereby performing recording. In the present exemplary embodiment, ink is ejected from the recording head 7, so that the recording is performed on the recording sheet 1. That is, the recording head 7 serves as an inkjet recording head. The recording head 7 is mounted on the carriage 10, and the carriage 10 makes a reciprocating movement in a direction intersecting with the sheet conveyance direction. That is, the carriage 10 includes the recording head 7, and moves bidirectionally in the direction intersecting with the sheet conveyance direction. A platen 8 supports a back surface of the recording sheet 1 in a position opposite the recording head 7.

Spurs 12 and 13 are rotated in contact with a recording surface of the recording sheet 1 on which the recording has been performed by the recording head 7. The recording sheet 1 on which the recording has been performed is discharged outside the recording apparatus 200 by the discharge roller 9.

A conveyance guide 15 guides a recording sheet 1 between a feeding nip formed between the feeding roller 3 and the feeding driven roller 4 and a conveyance nip formed between the conveyance roller 5 and the pinch roller 6. The conveyance guide 15 includes a sheet pressing lever 17 for causing a leading edge of a sheet to overlap with a trailing edge of a sheet preceding the sheet.

Moreover, on a downstream side of the feeding roller 3 in the sheet conveyance direction, a sheet detection sensor 16 is disposed to detect a leading edge and a trailing edge of the recording sheet 1. Moreover, a sheet detection sensor 18 is disposed on the downstream side of the feeding roller 3 and an upstream side of the conveyance roller 5 in the sheet conveyance direction. The sheet detection sensor 18 detects whether there is a recording sheet including a leading edge and a trailing edge thereof.

The use of the recording head 7 is not limited to color recording that is performed using a plurality of color recording materials. The recording head 7 can be used for monochrome printing that is performed using only a recording material of black (including gray). Moreover, printing is not limited to visible image printing. The printing may include printing of an invisible image or a low-visibility image. The printing may also include printing of various things other than a general image, for example, a wiring pattern, a physical pattern in manufacture of a product, and a base sequence of deoxyribonucleic acid (DNA) and so on.

Figure 3:
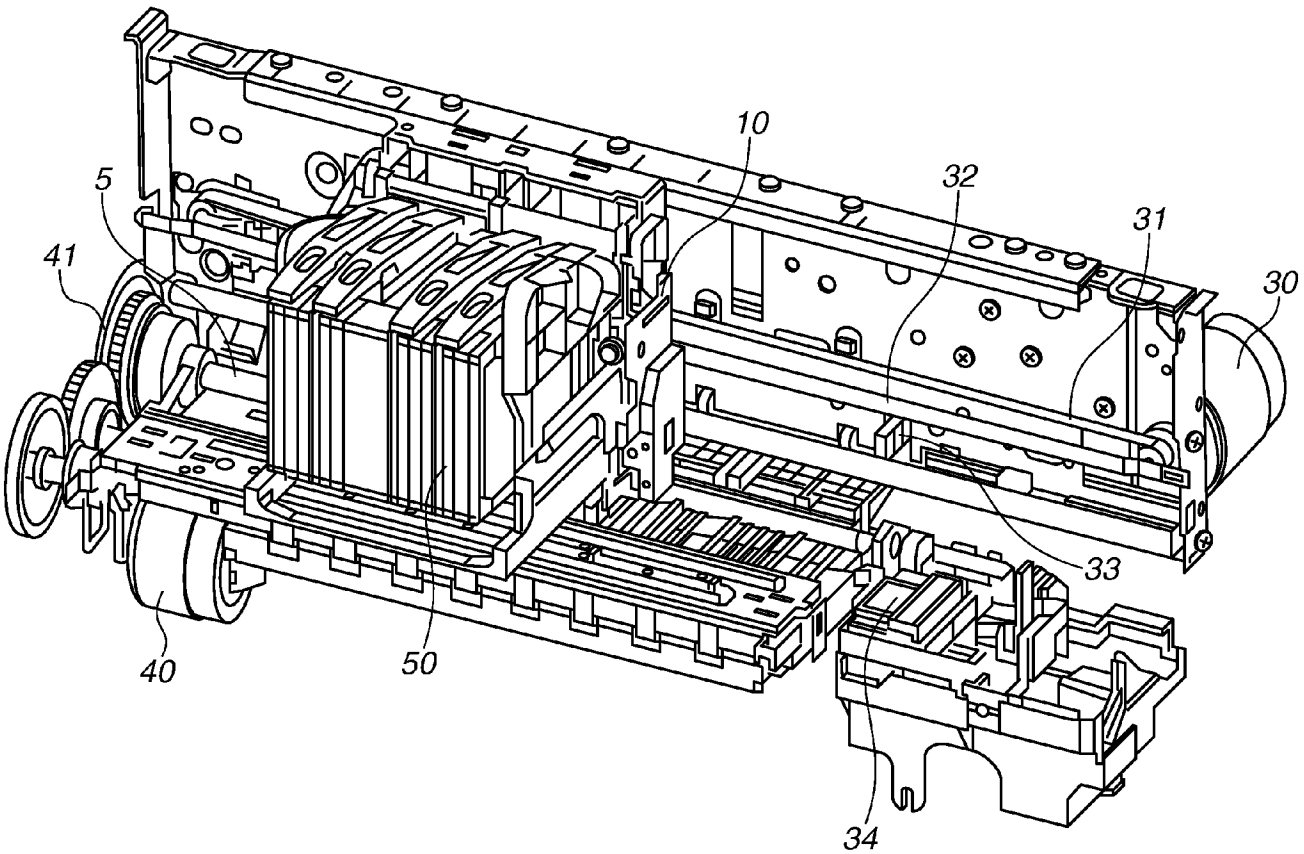
FIG. 3 is a perspective view illustrating the inside of the recording apparatus according to one exemplary embodiment of the present invention.

FIG. 3 is a perspective view illustrating the inside of the recording apparatus 200 according to the present exemplary embodiment. The recording head 7 is mounted on the carriage 10. The recording head 7 is supplied with ink from an ink tank 50, and ejects droplets of the supplied ink to perform printing. A carriage motor 30 corresponds to the carriage motor 204 illustrated in FIG. 1. The carriage motor 30 drives the carriage 10. The carriage motor 30 operates to rotate a belt 31, and the carriage 10 connected to the belt 31 thus moves laterally. A linear encoder 32 is disposed on a back side of the carriage 10. A position of the carriage 10 can be controlled by read of a slit on the linear encoder 32.

A conveyance motor 40 is used to convey a recording sheet. The conveyance motor 40 corresponds to the conveyance motor 205 illustrated in FIG. 1. When the conveyance motor 40 makes forward rotation, the conveyance roller 5 is rotated in a direction in which the recording sheet is discharged. This enables the recording sheet on the conveyance roller 5 to be conveyed and discharged. A rotary encoder 41 is a rotary encoder for the conveyance motor 40. The rotary encoder 41 reads a slit thereon to thereby control a position of the recording sheet conveyed by the conveyance motor 40.

A cap unit 34 is disposed in a movement direction of the carriage 10. The cap unit 34 is arranged in close contact with an ejection surface of the recording head 7 to thereby prevent an ejection failure caused by dryness of the recording head 7. A carriage lock pin 33 maintains a state in which the recording head 7 is covered with the cap unit 34. The carriage lock pin 33 projects with the recording head 7 being covered with the cap unit 34. This enables the carriage 10 to be fixed such that the carriage does not move laterally. The carriage lock pin 33 projects toward the movement direction of the carriage 10 when the conveyance motor 40 makes reverse rotation. The carriage lock pin 33 retracts when the conveyance motor 40 makes forward rotation.

Figure 4:
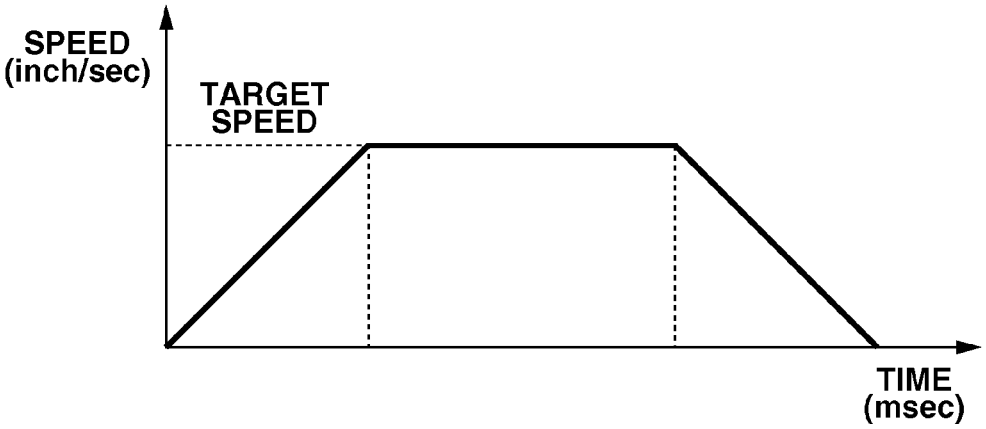
FIG. 4 is a diagram illustrating a profile of motor control according to one exemplary embodiment of the present invention.

Now, basic motor control according to the first exemplary embodiment is described with reference to FIG. 4. The term "motor" used herein represents the carriage motor and the conveyance motor 40. FIG. 4 illustrates a waveform of a speed profile in the motor control, where a horizontal axis indicates time and a vertical axis indicates target speed. In the motor control, a target speed is set, and a speed is increased (accelerated) at a certain rate to the target speed. Once the target speed is reached, the speed is maintained constant. Subsequently, the speed is decreased (decelerated) at a certain rate from a deceleration starting point. The deceleration starting point is calculated, for example, from a target stopping point and a speed. In the motor control for the conveyance motor 40, the slit on the rotary encoder 41 is read by a corresponding sensor. In the motor control for the carriage motor 30, the slit on the linear encoder 32 is read by a corresponding sensor. With the motor control, the number of passing slits is managed to control a position and a speed. As for motor abnormality detection, in a case where a slit is not changed for a certain time period while the motor is driving, that is, in a case where a movement amount is zero for consecutive times (detected positions of last time and this time are the same), it is determined that there is an abnormality. In the present exemplary embodiment, the certain time period is set to 80 msec. However, the present exemplary embodiment is not limited thereto. The certain time period may be set differently depending on a mechanical configuration and an electrical configuration. Slits on the linear encoder 32 that are read by the corresponding sensor are counted to thereby enable position management of the carriage 10 and thus the control of the carriage 10. An origin point of the position management is a position of the linear encoder 32 in a state where the carriage 10 is in contact with a side surface on which the carriage motor 30 is disposed, that is, the right side surface of the recording apparatus 200 when the recording apparatus 200 is seen from the front. The carriage control is control on the premise that the carriage 10 contacts a side surface. In the carriage control, a movement amount is zero, where the carriage 10 is in a contact state. Even when a normal operation is performed, the movement amount of zero remains for a predetermined time (particularly, a contact time). Therefore, a period during which the carriage control is performed is not considered as a period during which the above motor abnormality detection is targeted to be performed.

In the present exemplary embodiment, in a case where a carriage abnormality is detected, a cause of the abnormality is analyzed in more detail. An abnormal stop of the carriage 10 in the recording apparatus 200 can occur by the following reasons that are described with cases 1 through 5 below.

Case 1: An abnormal stop of the carriage 10 caused by a recording sheet. For example, there is a variety of types of "plain paper" with characteristics that vary depending on the manufacturer and the brand. The characteristics of the "plain paper" include a thickness of paper, a hardness of paper, a permeability of ink, and paper quality. With some types of paper, a conveyance failure may occur when an image is formed thereon. Specifically, when a recording apparatus forms an image by ejecting ink droplets on a paper surface, a phenomenon (hereinafter called curl) in which paper is circularly warped by absorption of moisture of the ink droplets may occur. Since paper has a course, a direction of the curl varies depending on a direction of the course (an orientation of fiber). One paper may curl in a conveyance direction. Other paper may curl in a scanning direction in which a carriage is moved. In some instances, insertion of the paper between rollers of a sheet discharging side may be extremely difficult depending on the curl. A recording sheet may be fed in a state where, due to the curl thereof, the recording sheet cannot be inserted between the rollers of the sheet discharging side. In such a case, a length of a portion, of the recording sheet, that stays between the discharge roller and the conveyance roller becomes longer than expected. The discharge roller and the conveyance roller have a fixed distance therebetween. Thus, if a length of the recording sheet is longer than or equal to the fixed distance, a portion of the recording sheet exceeding the fixed distance is led upward. If the carriage 10 performs, for example, scanning for printing in such a state, there may be a case where the recording sheet may interfere with the carriage 10 and the carriage 10 detects an abnormality.

Case 2: An abnormal stop of the carriage 10 caused by an obstacle. More specifically, an abnormal stop occurs when ink is replaced, for example. When ink in the recording head 7 runs out, the ink needs to be replaced. In such a case, a cover of the recording apparatus 200 is opened, and the carriage 10 including the ink is moved to a replacement position so that the ink is replaced. Herein, a movement of the carriage 10 may be disturbed by an external factor such as a human hand and an object while the carriage 10 is moving toward the position in which the ink is replaced. If such disturbance occurs, the carriage 10 detects an abnormality. Moreover, an external factor such as a vibration load and other factors may cause the carriage lock pin 33 to project to a scanning range (a movement range) of the carriage 10 although the projection of the carriage lock pin 33 is not needed. If such projection occurs, an abnormality is detected. The carriage lock pin 33 serving as a pin for fixing the carriage 10 is a member capable of moving inside and outside the scanning area of the carriage 10.

Case 3: An abnormal stop of the carriage 10 caused by abnormality of a motor. The carriage 10 is driven by the carriage motor via the belt, and moves by sliding on a rail. In such a sliding member, friction is generally increased due to changes caused by aging. The higher the friction is, the more electric current which is to be flowed to the motor becomes necessary to drive the carriage motor. In the motor, a load caused by the flow of a large current is increased. Moreover, a load due to a temperature rise caused by the flow of a large current is increased. In a case where such a load is applied for a long period, winding of the motor may be cut, for example. There may be a case where the carriage 10 detects an abnormality when such an abnormality as being occurred within a motor itself exists.

Case 4: An abnormal stop of the carriage 10 caused by abnormality of the linear encoder 32 or a reading unit of the linear encoder 32. For example, a failure in a linear encoder 32 may occur, or a failure in a reading unit of the linear encoder 32 may occur. In such a case, the carriage detects an abnormality.

Figure 5:
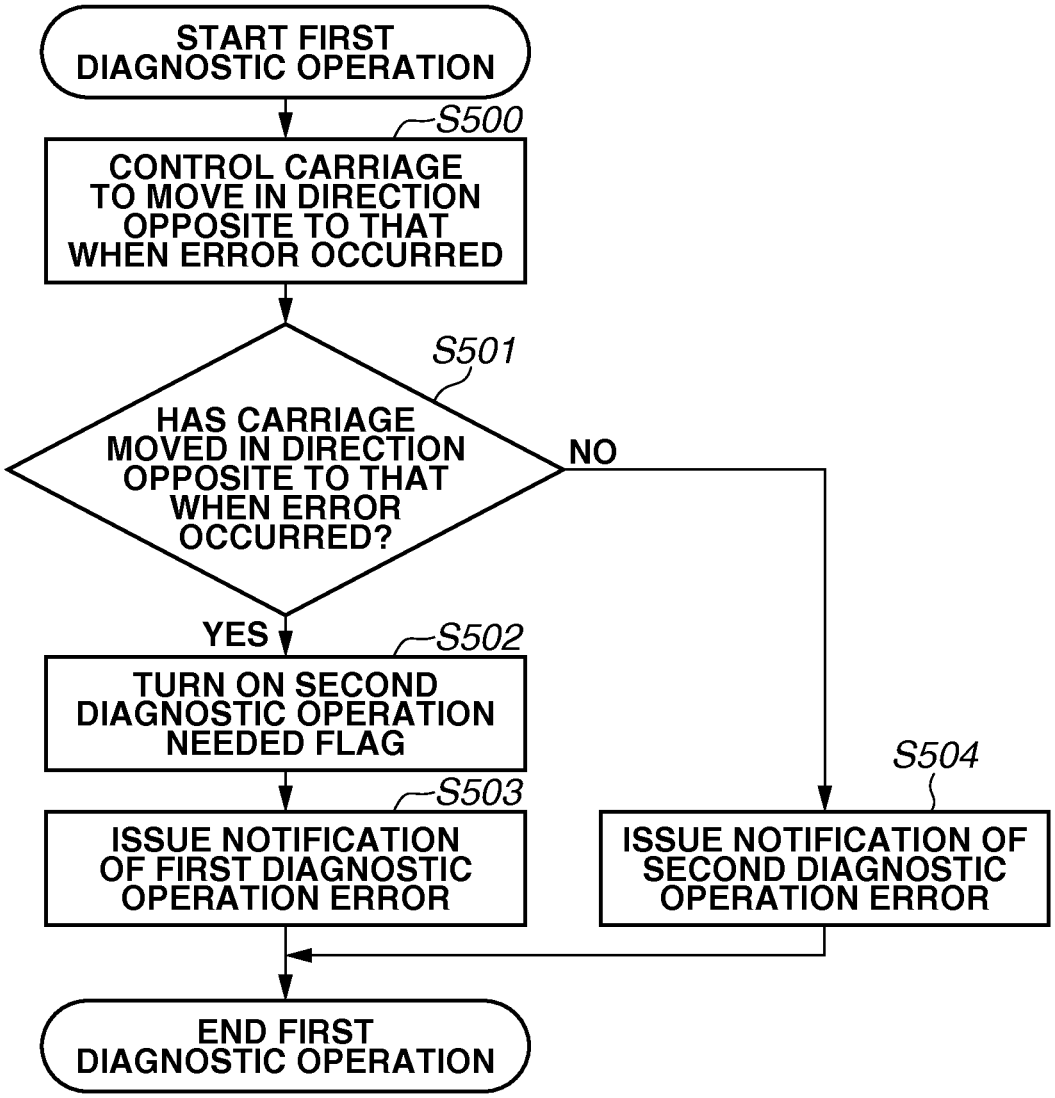
FIG. 5 is a flowchart illustrating a first diagnostic operation sequence according to one exemplary embodiment of the present invention.

Case 5: An abnormal stop of the carriage 10 due to displacement of a stop position caused by stains of the linear encoder 32. One example of the stains is that made from ink droplets. In a serial printer, ink droplets are ejected onto a paper surface. When the ink droplets are ejected, very small ink-droplets are generated in addition to ink droplets which momentarily reach the paper surface to form an image. Such small ink-droplets float inside the apparatus without reaching the paper surface. In some instances, the small ink-droplets adhere to a member inside the apparatus. In a case where the recording apparatus 200 is used for a long term, an adhesion amount of the ink droplets increases. An increase in the adhesion amount of the ink droplets to the reading unit for reading the slit on the linear encoder 32 causes the sensor to fail to correctly read the slit on the linear encoder 32. Moreover, another stain is made by contact by a user. In a case where the recording apparatus 200 detects a paper jam, an error is notified to a user to prompt the user to remove a factor of the paper jam. When the factor of the paper jam such as a recording sheet is to be removed from the front of the recording apparatus 200, the user puts his/her hand in the recording apparatus 200 to remove torn paper or a piece of paper that has dropped. Herein, grease applied on a roller or a gear may adhere to the paper or the hand, and then such paper or hand may contact the linear encoder 32. Adhesion of the grease to the linear encoder 32 causes the sensor to fail to correctly read the slit on the linear encoder 32. In a case where the sensor cannot correctly read the slit on the linear encoder 32, the carriage 10 cannot stop in the correct position. Consequently, the carriage 10 may be interfered by another member or unit. In such a case, an abnormality is detected in an operation of the carriage 10. FIG. 5 is a flowchart illustrating a first diagnostic operation sequence performed when an abnormality is detected in carriage motor control. The MPU 201 loads a program stored in the ROM 202 to the RAM 203, and executes each step of the flowchart illustrated in FIG. 5.

When an abnormality of the carriage 10 is detected, the MPU 201 starts the first diagnostic operation. In step S500, the MPU 201 controls the carriage 10 such that the carriage 10 moves in a direction opposite to that in which the carriage 10 has moved when the abnormality occurred. In step S501, the MPU 201 determines whether the carriage 10 has moved in the direction opposite to that in which the carriage 10 has moved when the abnormality occurred. With such control, the MPU 201 can check whether the carriage being driven by the carriage motor can move in only one direction or cannot move in two directions in a state that the abnormality has occurred. In a case where an abnormality is detected due to interference between the carriage 10 and a recording sheet, there is a possibility that the recording head 7 on the carriage 10 and the recording sheet may be in contact with each other. Thus, the carriage 10 should not be moved wherever possible. In this processing, the MPU 201 uses a minimum duty and time for determining whether the carriage 10 can move in the opposite direction, such that influence to the recording head side is reduced as much as possible with respect to the movement to the opposite side. In the present exemplary embodiment, the MPU 201 applies an output current with a duty (ON time of electric current) of 30% for 100 msec to check whether the carriage 10 can move.

If the MPU 201 determines that the carriage 10 cannot move (NO in step S501), the processing proceeds to step S504. In step S504, the MPU 201 issues notification of a second diagnostic operation error. If any of the carriage-abnormality cases 3 and 4 described above occurs, the notification of the second diagnostic operation error is issued. When the MPU 201 issues the notification of the second diagnostic operation error, the linear encoder 32 is more likely to have an abnormality, the reading unit for reading linear encoder 32 is more likely to have a failure, and/or the motor is more likely to have a failure. In such a case, there is a high possibility that the user cannot solve the problem, that is, the problem cannot be recovered by the user. In the present exemplary embodiment, therefore, the MPU 201 issues not only notification including an error and a method for dealing with the error, but also notification of necessity of repair if the error is not solved by the method. Such notification issued by the MPU 201 serves as the notification of the second diagnostic operation error. More specifically, a message such as "Printer trouble has occurred. Please perform the following." is displayed with a specific method for dealing with the trouble. In addition, a message such as "If the trouble is not solved, please refer to the instruction manual and ask for repair." is displayed. If the MPU 201 determines that the carriage 10 has moved in the opposite direction (YES in step S501), the processing proceeds to step S502. In step S502, the MPU 201 determines to perform a second diagnostic operation. The MPU 201 turns on a second diagnostic operation needed flag indicating that execution of the second diagnostic operation is necessary, and stores the necessity for the second diagnostic operation in a storage unit. That is, the MPU 201 stores information indicating that the second diagnostic operation is to be executed. The second diagnostic operation identifies a more specific cause of the abnormality. Since a state in which the carriage 10 cannot move is more likely to be caused by a paper jam or interference with an obstacle such as a mechanical member, the second diagnostic operation distinguishes whether the abnormality is caused by the paper jam or by the mechanical member. The ON flag in step S502 indicates that execution of the second diagnostic operation is necessary. The second diagnostic operation needed flag can be stored in the EEPROM 211 serving as a non-volatile memory, for example. This enables the MPU 201 to check the second diagnostic operation needed flag during start-up even if power is turned off after execution of the first diagnostic operation.

In step S503, the MPU 201 issues notification of first diagnostic operation error. The notification of first diagnostic operation error notifies that the carriage 10 has detected an abnormality due to interference with an obstacle. If a cause of the abnormality is a paper jam, there are cases where the paper jam may have occurred in a state that a recording sheet is not provided on the sensor for detecting a recording sheet. In such a case, the user can identify a cause of abnormal stop of the carriage 10 by user intervention made resulting from to the notification. In the present exemplary embodiment, a message such as "The carriage unit has detected an obstacle and is not movable. Please check whether there is a paper jam inside the apparatus. If the paper jam is found, please remove the jammed paper and restart the recording apparatus." is displayed on the display unit. In the present exemplary embodiment, when the first diagnostic operation error is notified, causes of the abnormal stop of the carriage 10 include two cases. One case such as a paper jam can be recovered by the user, whereas the other case such as a failure in the apparatus cannot be recovered by the user. In the user-recoverable case, the user eliminates the cause of the error such as a paper jam, and then starts the recording apparatus again on the premise that a check is performed whether the case was a user-recoverable case. Accordingly, in the present exemplary embodiment, when the first diagnostic operation error is displayed, the user is prompted to restart the recording apparatus.

In the first diagnostic operation of the present exemplary embodiment, therefore, different diagnostic operation errors are notified depending on a carriage movement result acquired in step S501.

Figure 6:
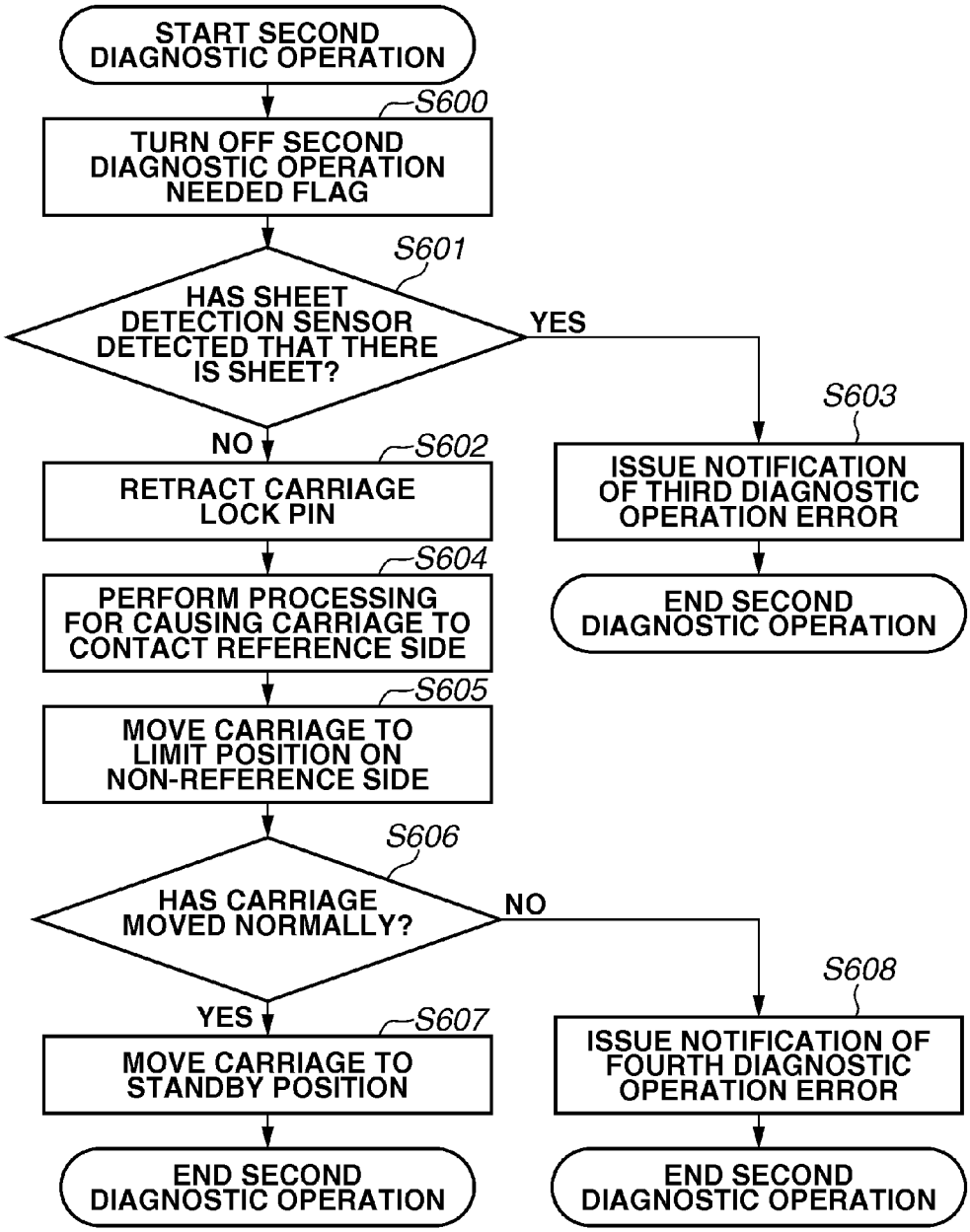
FIG. 6 is a flowchart illustrating a second diagnostic operation sequence according to one exemplary embodiment of the present invention.

FIG. 6 is a flowchart illustrating a detailed sequence of the second diagnostic operation executed based on an instruction from a user when a first diagnostic operation error occurs in the first diagnostic operation. The MPU 201 loads a program stored in the ROM 202 to the RAM 203, and executes each step of the flowchart illustrated in FIG. 6. A user turns off a power button of the recording apparatus 200 and then turns on the power button to restart the recording apparatus 200. In the present exemplary embodiment, such restart is used as a trigger to execute the second diagnostic operation. More specifically, in the present exemplary embodiment, the MPU 201 checks whether a second diagnostic operation needed flag is ON at the time of restart. If the flag is ON, the MPU 201 executes the second diagnostic operation. This enables the second diagnostic operation to be executed only when the recording apparatus 200 is restarted in a state where a cause of an abnormality needs to be identified by the second diagnostic operation.

In the present exemplary embodiment, the restart is used as a trigger to execute the second diagnostic operation, the restart being performed after the first diagnostic operation error is notified. However, the present exemplary embodiment is not limited thereto. For example, the MPU 201 may receive confirmation with respect to the first diagnostic operation error from the user through a key operation, and such a key operation may be used as a trigger. Alternatively, the user may issue a direct instruction for execution of the second diagnostic operation after the first diagnostic operation error is notified, and such an instruction may be used as a trigger to execute the second diagnostic operation. In such a case, the MPU 201 does not need to perform step S502 in which the second diagnostic operation needed flag is turned on. That is, the MPU 201 does not need to set the flag.

In step S600 in the second diagnostic operation sequence, the MPU 201 turns off a second diagnostic operation needed flag. Herein, in a case where the first diagnostic operation error is being displayed on the display unit, such display of the first diagnostic operation error is cancelled. In the present exemplary embodiment, since the second diagnostic operation is executed at the time of starting the apparatus, the first diagnostic operation error should basically not be displayed on the display unit.

In step S601, the MPU 201 checks a sheet detection sensor. If the sheet detection sensor has detected that there is a sheet (YES in step S601), the processing proceeds to step S603. In step S603, the MPU 201 issues notification of a third diagnostic operation error, and the second diagnostic operation ends. The notification of third diagnostic operation error notifies that a paper jam has occurred. In the present exemplary embodiment, a message such as "Paper jam has occurred. Please remove the paper" is displayed on the display unit. In the carriage-abnormality case 1 described above, the user is prompted to check the inside of the recording apparatus 200 when the first diagnostic operation error occurs, so that the user can prevent an error. Herein, in such a situation, the user may issue an instruction for execution of the second diagnostic operation without noticing. In such a case, the sheet detection sensor detects the recording sheet (YES in step S601), then in step S603, the MPU 201 can issue notification that a carriage error has occurred due to the paper jam.

If the sheet detection sensor has detected that there is no sheet (NO in step S601), the processing proceeds to step S602. In step S602, the MPU 201 retracts the carriage lock pin 33. The retraction of the carriage lock pin 33 represents processing by which the carriage lock pin 33 is retracted outside a scanning area of the carriage 10. In the present exemplary embodiment, the carriage lock pin 33 is retracted. However, the present exemplary embodiment is not limited thereto. The retraction processing may be performed on a member that has the possibility of interfering with carriage scanning, so that the carriage scanning can be reliably performed from a mechanical configuration viewpoint. That is, in addition to the carriage lock pin 33, if there is a member, such as a component, a member, and a unit of the recording apparatus 200, that has the possibility of interfering with carriage scanning, the retraction processing is executed on such a potential obstacle. Concretely, a unit motor for driving a unit that is a potential obstacle to the carriage is controlled, so that the unit is moved. The execution of this processing enables the apparatus to recover as long as a cause of the abnormality is interference with the carriage lock pin 33 and interference with a mechanical member or unit as the carriage-abnormality case 2 described above.

Subsequently, in step S604, the MPU 201 performs processing for causing the carriage 10 to contact a reference side. A position in which the carriage 10 contacts the reference side is set as an origin point in the carriage control. This position is used as the origin point until the carriage 10 contacts the reference side again to define an origin point. In step S605, the MPU 201 moves the carriage 10 to a limit position on the non-reference side, and determines, in step S606, whether the carriage 10 has moved normally. This operation enables the MPU 201 to check whether the carriage 10 can correctly move in a movable range according to the control. The movable range is a range in which the carriage 10 can move from a mechanical configuration viewpoint.

If the MPU 201 determines that the carriage 10 cannot move normally (NO in step S606), the processing proceeds to step S608. In step S608, the MPU 201 issues notification of a fourth diagnostic operation error to notify that there is an area in which the carriage 10 cannot operate normally although the motor unit is in a state of enabling the carriage 10 to operate. In the present exemplary embodiment, a message such as "On the linear encoder of the carriage, there may be partially an area in which correct reading is not performed." is displayed on the display unit. As for the carriage-abnormality case 5 described above, if the MPU 201 determines that the carriage 10 cannot move normally (NO in step S606), the processing proceeds to step S608 in which notification of a fourth diagnostic operation error is issued.

If the MPU 201 determines that the carriage 10 can move normally (YES in step S606), the processing proceeds to step S607. In step S607, the MPU 201 moves the carriage 10 to a standby position, and this sequence ends. Such a case includes the following. For example, when a first diagnostic operation error is notified in a first diagnostic operation, a user removes a sheet to solve the paper jam. In such a case, initialization processing is executed such that the error is cancelled and the recording apparatus 200 becomes ready for printing. In the present exemplary embodiment, the second diagnostic operation is executed at the time of starting the recording apparatus 200. Subsequently, initialization processing of a recovery system unit and a sub-scanning system unit is executed. This enables the recording apparatus 200 to be ready for immediate printing when a print command is received.

According to the second diagnostic operation of the present exemplary embodiment, therefore, the check of the detection of the sheet detection sensor is used for identifying a cause of an abnormality of the motor. Moreover, the carriage is moved after the retraction processing is performed as needed. Thus, different diagnostic operation errors are notified depending on execution results of these operations.

In the present exemplary embodiment, if an abnormality is detected in the carriage motor control, processing for analyzing a cause of the abnormality in more detail is executed by driving other motors including the carriage motor 204. This enables a cause of the abnormality to be identified even in a case where a failure in the recording apparatus 200 such as a sensor failure occurs, thereby increasing the number of cases that can be notified to the user with an appropriate failure location.

In the present exemplary embodiment, an error is once notified in the first diagnostic operation to prompt the user to intervene. This can increase the number of cases in which a cause of an abnormality can be identified, the cause of the abnormality, such as a paper jam, that cannot be detected by a sensor mounted in the recording apparatus 200. According to the present exemplary embodiment, if the MPU 201 determines that the carriage 10 can move in a direction opposite to that in which the carriage 10 has moved when the error occurred in the first diagnostic operation, execution of the second diagnostic operation is determined. Therefore, a cause of the abnormality can be identified in more detail.

Moreover, when execution of the second diagnostic operation becomes necessary in the first diagnostic operation, such information is stored in a non-volatile memory, for example. Consequently, even if power is shut down in an abnormal state, the second diagnostic operation is executed at next start. The storage control is performed by the MPU 201, for example. Since the necessity for the second diagnostic operation is stored in the storage unit such as the non-volatile memory, an abnormality of the recording apparatus 200 can be appropriately notified to the user after execution of the first diagnostic operation even if power of the recording apparatus 200 is shut down due to an unforeseen event.

As described above, in a case where the recording apparatus 200 has a problem with the carriage 10, the user can appropriately deal with the problem based on the display. This can reduce downtime in which the recording apparatus 200 cannot be used.

According to the present exemplary embodiment, it becomes possible, for more cases when a movement error is detected, to identify a cause of an abnormality. Moreover, a time necessary to identify a cause of an abnormality can be shortened.

Other Embodiments

The present invention is not limited to the above exemplary embodiment. For example, in the above-described exemplary embodiment, various error notifications are displayed on the display unit of the recording apparatus 200. However, the above exemplary embodiment of the present invention is not limited thereto. Error notification may be displayed on a display unit on the personal computer 100.

In the above-described exemplary embodiment, the recording apparatus 200 is restarted after a first diagnostic operation error is notified. However, the above exemplary embodiment of the present invention is not limited thereto. The recording apparatus 200 may execute a second diagnostic operation without performing restart processing.

In the above-described exemplary embodiment, the flag indicating whether execution of the second diagnostic operation is necessary is stored in a non-volatile memory. However, the above exemplary embodiment of the present invention is not limited thereto. Such a flag may be stored in the RAM 203.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-169778, filed Aug. 22, 2014, which is hereby incorporated by reference herein in its entirety.

What is claimed is:

1. A control device comprising:

a moving unit configured to cause a recording unit to move in a reciprocating manner;

a detection unit configured to detect a movement error of the moving unit;

a control unit configured to control the moving unit such that the recording unit is caused to move in a second direction in a case where the movement error is detected by the detection unit while the recording unit is being caused to move in a first direction;

a notification unit configured to issue error notification; and an execution unit configured to execute an operation for identifying a cause of the movement error of the moving unit in a case where the moving unit has been able to move in the second direction by the controlling of the control unit, wherein the notification unit issues first error notification, in a case where the moving unit has been able to move in the second direction by the controlling of the control unit, wherein the notification unit issues second error notification different from the first error notification, in a case where the moving unit has not been able to move in the second direction by the controlling of the control unit, and wherein the execution unit executes the operation after the first error notification has been issued.

2. The control device according to claim 1, wherein an operation to be executed by the execution unit includes a determination of whether a recording medium is detected near the recording unit.

3. The control device according to claim 1, further comprising a driving unit configured to drive a unit motor that moves a member capable of moving inside and outside of a movement range of the recording unit, wherein an operation to be executed by the execution unit includes retraction processing and determination processing, the retraction processing being performed such that the unit motor is driven by the driving unit to move the member outside of the movement range of the recording unit, and the determination processing being performed after the retraction processing to determine whether the moving unit has been able to move normally.

4. The control device according to claim 3, wherein, in a case where it is determined by the determination processing that the moving unit has been able to move normally by the execution of the operation by the execution unit, the notification unit does not issue error notification corresponding to a result of the operation by the execution unit.

5. The control device according to claim 3, wherein the notification unit issues third error notification different from the first error notification and the second error notification, in a case where it is determined by the determination processing that the moving unit is not able to move normally, and wherein processing is performed such that a recording apparatus including the recording unit becomes able to record, in a case where it is determined by the determination processing that the moving unit is able to move normally.

6. The control device according to claim 1, further comprising an instruction unit configured to instruct the execution unit to execute an operation, wherein, in a case where an instruction for execution of the operation is received from the instruction unit, the execution unit executes the operation.

7. The control device according to claim 1, wherein, the first error notification includes notification to prompt a user to restart a recording apparatus including the recording unit, and wherein the execution unit executes an operation after restart of the recording apparatus.

8. The control device according to claim 7, further comprising a storage control unit configured to store information for causing the execution unit to execute an operation in a storage unit in a case where the moving unit has been able to move in the second direction by the controlling of the control unit, wherein, in a case where the information for causing the execution unit to execute the operation is stored in the storage unit at a time of starting a recording apparatus including the recording unit, the execution unit executes the operation.

9. The control device according to claim 8, wherein the storage unit is a non-volatile memory.

10. The control device according to claim 1, further comprising the recording unit.

11. The control device according to claim 1, wherein the second error notification includes notification of a method for dealing with the movement error of the moving unit.

12. The control device according to claim 11, wherein the method for dealing with the movement error of the moving unit includes notification to prompt a user to repair.

13. The control device according to claim 1, wherein the first error notification includes a notification to prompt a user to remove a recording medium.

14. The control device according to claim 1, wherein the member includes a carriage lock pin.

15. A control method comprising:

moving a recording unit in a reciprocating manner by using a moving unit;

detecting a movement error of the moving unit;

controlling the moving unit such that the recording unit is caused to move in a second direction in a case where the movement error is detected by the detecting while the recording unit is being caused to move in a first direction;

issuing error notification; and executing an operation for identifying a cause of the movement error of the moving unit in a case where the moving unit has been able to move in the second direction by the controlling, wherein in the issuing, first error notification is issued in a case where the moving unit has been able to move in the second direction, wherein in the issuing, second error notification different from the first error notification is issued in a case where the moving unit has not been able to move in the second direction, and wherein, the operation is executed after the first error notification has been issued.

16. A non-transitory computer-readable recording medium storing a program for causing a computer to execute a method comprising:

moving a recording unit in a reciprocating manner by using a moving unit;

detecting a movement error of the moving unit;

controlling the moving unit such that the recording unit is caused to move in a second direction in a case where the movement error is detected by the detecting while the recording unit is being caused to move in a first direction;

issuing error notification; and executing an operation for identifying a cause of the movement error of the moving unit in a case where the moving unit has been able to move in the second direction by the controlling, wherein in the issuing, first error notification is issued in a case where the moving unit has been able to move in the second direction, wherein in the issuing, second error notification different from the first error notification is issued in a case where the moving unit has not been able to move in the second direction, and wherein, the operation is executed after the first error notification has been issued.

* * * * *